United States Patent [19]

Richardson

[11] Patent Number: 4,987,868

[45] Date of Patent: Jan. 29, 1991

[54] SPARK PLUG HAVING AN ENCAPSULATED CENTER FIRING ELECTRODE GAP

[75] Inventor: Ronald D. Richardson, Pekin, Ill.

[73] Assignee: Caterpillar Inc., Peoria, Ill.

[21] Appl. No.: 348,830

[22] Filed: May 8, 1989

[51] Int. Cl.[5] ..... F02B 19/12

[52] U.S. Cl. ..... 123/260; 123/263; 123/266; 123/527; 313/143

[58] Field of Search ..... 123/260, 262, 263, 266, 123/293, 143 B, 527; 313/143

[56] References Cited

U.S. PATENT DOCUMENTS

| | | | |
|---|---|---|---|
| 2,118,058 | 5/1938 | Riley | 123/263 |
| 2,127,512 | 8/1938 | Harper, Jr. | 123/169 |
| 2,127,513 | 8/1938 | Harper, Jr. | 313/143 |
| 2,153,598 | 4/1939 | Steward | 123/169 |
| 2,843,780 | 7/1958 | Harper, Jr. | 313/143 |
| 2,871,388 | 1/1959 | Adair | 313/143 |
| 2,895,069 | 7/1959 | Davis | 313/143 |
| 3,076,912 | 2/1963 | Novak et al. | 313/143 |
| 4,174,679 | 11/1979 | Noguchi et al. | 123/263 |
| 4,305,357 | 12/1981 | Scherenberg et al. | 123/254 |
| 4,327,681 | 5/1982 | Latsch et al. | 123/260 |
| 4,332,224 | 6/1982 | Latsch et al. | 123/254 |
| 4,361,122 | 11/1982 | Latsch | 123/266 |
| 4,416,228 | 11/1983 | Benedikt et al. | 123/268 |
| 4,442,807 | 4/1984 | Latsch et al. | 123/263 |
| 4,509,476 | 4/1985 | Breuser et al. | 123/266 |
| 4,513,708 | 4/1985 | Latsch et al. | 123/263 |
| 4,715,337 | 12/1987 | Bohl et al. | 123/169 PA |

FOREIGN PATENT DOCUMENTS

| | | | |
|---|---|---|---|
| 2172223 | 9/1986 | United Kingdom | 313/143 |

OTHER PUBLICATIONS

SAE Technical Paper Series No. 840455, Entitled: The Swirl-Chamber Spark Plug: A means of Faster, More Uniform Energy Conversion in the Spark-Ignition Engine, Dated Feb. 27, 1984, by R. Latsch.

*Primary Examiner*—Andrew M. Dolinar
*Attorney, Agent, or Firm*—J. W. Blumenshine

[57] ABSTRACT

A spark plug of an engine ignition/combustion system have the electrode gaps of the spark plug surrounded by a capsule having a controlled orifice system. The orifice system and electrode gap are positioned, sized, and oriented specifically for use with lighter-than-air fuel gas.

11 Claims, 2 Drawing Sheets

62
10
92
74
17
17
68
24
18
64
22
54
12
46
70
72
50
66
14
52

SPARK PLUG HAVING AN ENCAPSULATED CENTER FIRING ELECTRODE GAP

DESCRIPTION

1. Technical Field

This invention relates to spark plugs having a centrally located electrode gap and an orificed capsule which surrounds and encapsulates the electrode gap of the spark plug, the electrode gap being substantially centrally located within the capsule. The capsule provides improved ignition and the centrally located gap is particularly advantageous for use with lighter-than-air gaseous fuels such as methane.

2. Background Art

Demands placed on ignition systems have escalated steadily in recent years. These demands result from the somewhat antagonistic efforts to decrease fuel consumption and emissions while simultaneously improving engine smoothness and increasing power output. To achieve better ignition with conventional J-gap spark plugs, worldwide practice saw the electrode gap increased which in turn meant a higher energy requirement to produce a spark. In turn, these higher energy ignition systems tended to increase spark plug wear, an effect which was countered by increasing the center electrode's diameter But, because a larger electrode has a greater quenching effect on the spark, this trend adversely affected combustion.

Efforts to avoid such problems and improve energy conversion have resulted in a number of solutions. However, many solutions developed so far are comparatively expensive and often effective only in certain operating ranges. Thus, only a few of them have found their way into production, and those only under the pressure of extremely stringent emission legislation.

One of these is double ignition with dual spark plugs. In combination with intake swirl in the combustion chamber, this arrangement achieves fairly even combustion and more rapid energy conversion. Another solution involves split intake orifices and a second intake valve to achieve orderly swirl in the combustion chamber under lower partial-load conditions.

Another solution for even ignition and rapid energy conversion is the stratified-charge engine. Such engines are disclosed in U.S. Pat. No. 4,218,992, entitled "Externally Ignited Internal Combustion Engine" which issued to Latsch et al. on Aug. 26, 1980 and U.S. Pat. No. 4,361,122, entitled "Internal Combustion Engine With Externally-Supplied Ignition, Having One Main Combustion Chamber Per Cylinder And One Ignition Chamber" which issued to Latsch on Nov. 30, 1982. Such engines have a second mixture-formation path and pre-ignition chambers. Such engines are relatively extremely expensive and the relatively large volume of the pre-ignition chamber necessary to handle the rich portion of the mixture adversely affects thermal efficiency and, because of flow and thermal losses, power output is reduced.

The preceding discussion points up the need for a solution that combines to the highest possible degree the advantages of conventional ignition, such as moderate cost, compactness, and high specific power output, with those of unconventional combustion systems, such as low fuel consumption, low emissions and good engine smoothness.

One such solution that provides reliable, uniform and rapid initiation of combustion and rapid propagation of the flame front into the combustion chamber producing rapid combustion of the main charge is a spark plug having an orificed capsule which encapsulates the electrode gap.

Spark plugs having an orificed capsule which encapsulates the electrode gap are well known. The orificed capsule is intended to serve as a substitute for the pre-ignition chambers of the stratified-charge engine. Such capsules have been referred to in the literature as chambers, multi-torch, swirl chambers and others. Spark plugs of this type are disclosed in U.S. Pat. No. 2,127,512, entitled "Spark Plug" which issued to Harper on Aug. 23, 1938; U.S. Pat. No. 2,153,598, entitled "Internal Combustion Engine" which issued to Steward on Apr. 11, 1939; and U.S. Pat. No. 4,513,708, entitled "Method For Igniting Lean Fuel-Air Mixtures And An Apparatus To Perform The Method" which issued to Latsch et al. on Apr. 30, 1985. Such spark plugs often have a separate or unitary capsule which is sealably connected to the metal shell of the plug. The capsule extends down beyond and encapsulates the electrode gap. The capsule typically has tangential and bottom orifices which allow the exchange of gases between the inside of the capsule, this inside volume of the capsule hereafter also referred to as the ignition chamber, and the combustion chamber of the engine. The '512 and '598 patents disclose spark plugs which can be labeled as center-firing because the electrode gap and consequently the spark is substantially in the center of the capsule. The '708 spark plug can be labeled as side-firing because the electrode gap, and consequently the spark, is near the inside wall of the capsule.

In orificed encapsulated spark plugs, the combustible mixture is forced through the orifices of the capsule into the ignition chamber during the compression stroke of the piston causing swirling of the mixture in the ignition chamber. It can be theorized that when a spark is made to jump across the gap between the electrodes, the swirling action in the ignition chamber will serve to draw the spark from a central portion of the gap toward the edge portion thereof, thereby increasing the length of the spark and decreasing its amperage. The lengthening of the spark reduces its heating effect on the electrodes and the danger of pitting of the electrodes, and it also makes the ignition more effective, particularly during starting. The combustible mixture ignited in the ignition chamber expands and is thereby forcibly ejected through the orifices of the capsule into the combustion chamber of the engine to ignite the main charge in the latter. By reason of the reduced cross-section of the orifices, the ignited mixture ejected into the combustion chamber is accelerated during its passage through the orifices to enter the cylinder at high velocities, thereby improving the ignition of the main charge in the cylinder. The rapidity of the ignition of the fuel mixture contained in an internal combustion engine is one of the factors which affects the power output per unit of fuel and also the smoothness of operation. For most satisfactory operation of the engine, the ignition of the entire fuel charge should be as nearly as possible instantaneous. The jets of flame firing from the multiple orifices of the capsule increase the turbulence of the gas-air mixture in the cylinder of the engine and assure better mixture of the gas and air and more complete and rapid combustion. Upon ignition of the main charge in the cylinder, the pressure in the cylinder becomes greater than the pressure within the capsule of the spark plug so that hot burnt gases start to re-enter the chamber. However, such hot burnt gases are cooled by expansion in flowing from the orifices of relatively small cross-section into the ignition chamber. From the foregoing, it is apparent that heating of the electrodes from both the heat of the spark itself and the heat of the hot burnt gases which reenter the capsule is materially reduced thereby increasing the operative life of the electrodes and, hence, of the spark plug having the above described characteristics.

Given the aforementioned advantages and the fact that encapsulated spark plugs have been known for over fifty years, one could question why such plugs are not widely used. In the automotive industry, the incremental advantages in comparison to the relatively high cost has limited their use. However, in other industries where performance is worth the cost, such as the airline industry, such plugs are used.

In most circumstances, such plugs are used in lean burn liquid fueled (i.e. gasoline) engines. Typically, the capsule has four tangential and one bottom axial orifices. During the compression stroke, fuel is forced through the orifices into the ignition chamber. Because of the orientation of the orifices, a turbulent swirl is created in the ignition chamber. The heavier than air-gasoline molecules are centrifuged creating a gasoline rich region around the inside wall of the capsule and a gasoline poor region in the center of the capsule. Clearly, the center-firing encapsulated plugs discussed earlier, which would be producing a spark in the gasoline poor center region, would not provide optimum combustion. Thus, the side-firing plugs were viewed as an improvement over the center-firing plugs because the spark was placed in the gasoline rich side region of the capsule and better ignition resulted. Such side-firing plugs became the standard and center-firing encapsulated plugs were essentially obsolete.

However, not all engines are fueled by gasoline. In fact, as emission requirements became more stringent it was determined that a natural gas mixture, primarily comprised of methane, would produce fewer regulated emissions than gasoline. Through statistical experimentation, it became evident that the side-firing encapsulated spark plugs were achieving less than optimum combustion in lighter-than-air methane burning engines. Analytically, it was determined that through centrifuge the air molecules were forced against the inside wall of the capsule and the methane molecules were swirling in the center of the capsule, just the opposite of gasoline fuel. By an inventive step, even though the center-fire encapsulated plug had been discarded for use in gasoline engines and had fallen generally into obsolescence, it was determined and eventually confirmedly tested that placing the electrode gap in the center of the capsule and controlling the orifice system produced quicker and more complete ignition than a side-firing arrangement.

In order to further reduce emissions, these methane burning engines are often operated very lean. In other words, the combustible component of the fuel mixture (i.e. methane) is low compared to prior mixtures. To obtain sufficient power at such lean conditions requires a large turbocharger boost. The compression ratio is typically very high. Further, because of the accelerated burn rate provided by the capsule, ignition timing must be carefully controlled. All of these factors contribute to the extremely high pressures exerted on the electrode gap. Because spark ionization voltage is proportional to the electrode gap pressure, the voltage necessary to produce a spark is extremely high. Because such high voltages would create an arc over down a short insulator resulting in a misfire, the insulator of the plug extending above the metal body must be relatively long. The long insulator adds to the useful life of the plug by preventing arc over even after the electrodes have begun to erode.

Further, as discussed earlier, pitting and deterioration of the electrodes is a problem in spark plugs, especially in a lean burn engine. As the tips pit and erode, it becomes harder for the same voltage to produce a spark across the gap. Eventually, a higher energy (i.e. voltage) is necessary to create a spark or the spark plug misfires or completely fails. As the electrodes erode, it becomes easier for a spark to arc down from the electrical connection to the metal spark plug body. It is possible to prevent or postpone the arc-over by further increasing the length of the insulator. Of course, however, increasing its length increases costs and the design of certain engines prevents the use of an excessively long insulator.

It has been found that electrodes having precious metal tips will last longer and perform better than spark plugs without. By the use of such tips, the useful life of the spark plug is increased and the length of the insulator can be maintained within tolerable limits. A platinum tip on the ground electrode and an iridium tip on the center electrode are extremely durable and functional.

In addition, it has been found that in order to obtain the maximum benefit of the flame propagation from the ignition chamber, the spark plug, or at least the swirl chamber, should be centrally located in the main combustion chamber. The problem if the plug is not centrally located is that the flame exiting the orifice closest to the main combustion chamber wall hits the wall and partially extinguishes before it is entirely utilized. Also, the flame exiting the orifice farthest from the wall may dissipate before igniting the most distant gas molecules. Thus, there is non-uniform and less than optimum combustion. However, if the plug is centrally located, the flame exits the orifices and will distribute itself uniformly in the main combustion chamber thus providing the optimum obtainable combustion. Typically, four valve cylinders are best adapted for centrally located spark plugs, however, centrally mounted plugs have been used in two and three valve cylinders also.

DISCLOSURE OF THE INVENTION

In one aspect of the invention a spark plug is specially adapted for use in a lighter-than-air gaseous fuel burning engine. The spark plug has a shell, a center electrode and a ground electrode. The electrodes are spaced one from the other and form an electrode gap. A capsule has an ignition chamber and an orifice system for the controlled exchange of gasses into and from the ignition chamber. The capsule is connected to the spark plug shell. The inner volume of the capsule is the ignition chamber said electrode gap being substantially centered within said ignition chamber. The orifice system has a plurality of orifices. The orifices are of a size, orientation, and position adapted for the entry of lighter-than-air gaseous fuel through the orifices, into the ignition chamber, and along a swirling pathway around the electrode gap.

In another aspect of this invention, a spark ignited gaseous fueled power system has an engine head. The engine head has a spark plug well having first and second ends and a length of about 25 centimeters. An engine block of the system has a piston, a piston cylinder, and a combustion chamber defined by said piston, said piston cylinder, and said second end of said spark plug well. A plurality of valve means provide for the intake and exhaust of gases for said combustion chamber. A spark plug has a shell, an insulator, a center electrode, a ground electrode, and a capsule. The insulator is fixedly held in the shell, extends about and through said shell and at least 5.2 centimeters beyond said shell. The electrodes are spaced one from the other and define an electrode gap therebetween. The capsule has an ignition chamber and an orifice system for the controlled exchange of gasses into and from the ignition chamber. The capsule is connected to the spark plug shell, said electrode gap being substantially centered within said ignition chamber. The orifice system has a plurality of orifices of a size, orientation and position adapted for the entry of fuel gas through the orifices, into the ignition chamber and along a swirling pathway around the electrode gap. The orifices are positioned within the engine block combustion chamber. An insulated spark plug extender is connected at one end to said spark plug and extends toward the first end of said spark plug well. A power source adapted to deliver at least 8000 volts is connected to the spark plug extender. Means is provided for controllably delivering fuel gas into the combustion chamber.

BEST MODE FOR CARRYING OUT THE INVENTION

Figure 1:
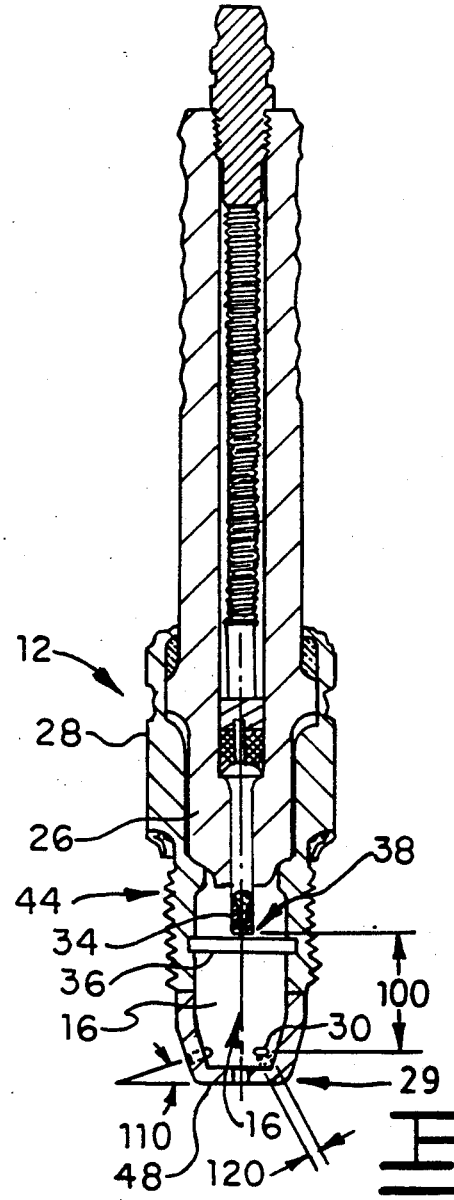
FIG. 1 is a diagrammatic sectional view of a preferred embodiment of a spark plug taken through the axial centerline.
Figure 3:
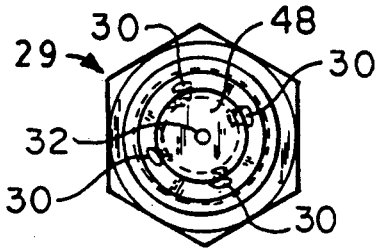
FIG. 3 is a diagrammatic bottom perspective view of a preferred embodiment of the capsule showing the orifices.

Referring to FIG. 1, a preferred embodiment of a spark plug 12 has a spark plug shell 28 in which there is held an insulator 26. The shell 28 is provided with a threaded portion 44 to readily screw into a threaded hole 46 in the engine head 54 (FIG. 3). A center electrode 34 and a ground electrode 36 are provided and positioned so as to form an electrode gap 38 between them to produce an electric arc. A capsule 48 having orifices 30,32 encapsulates the electrode gap 38, the inside volume of the capsule 48 forming an ignition chamber 16. The capsule 48 is connected to the shell 28. In a preferred embodiment, the shell 28 and capsule 48 are made of nickel. The capsule 48 has a thickness of about 2 millimeters.

The spark plug 12 of the present invention is specially adapted for use in spark ignited engines using a lighter-than-air gaseous fuel, such as methane. The special adaptation includes the positioning of the electrode gap 38 substantially in the center of the capsule 48 and the angular directioning of orifices 30 of the orifice system (29) of the capsule 48. In this manner, improved ignition of the lighter-than air gas fuel is achieved.

Figure 2:
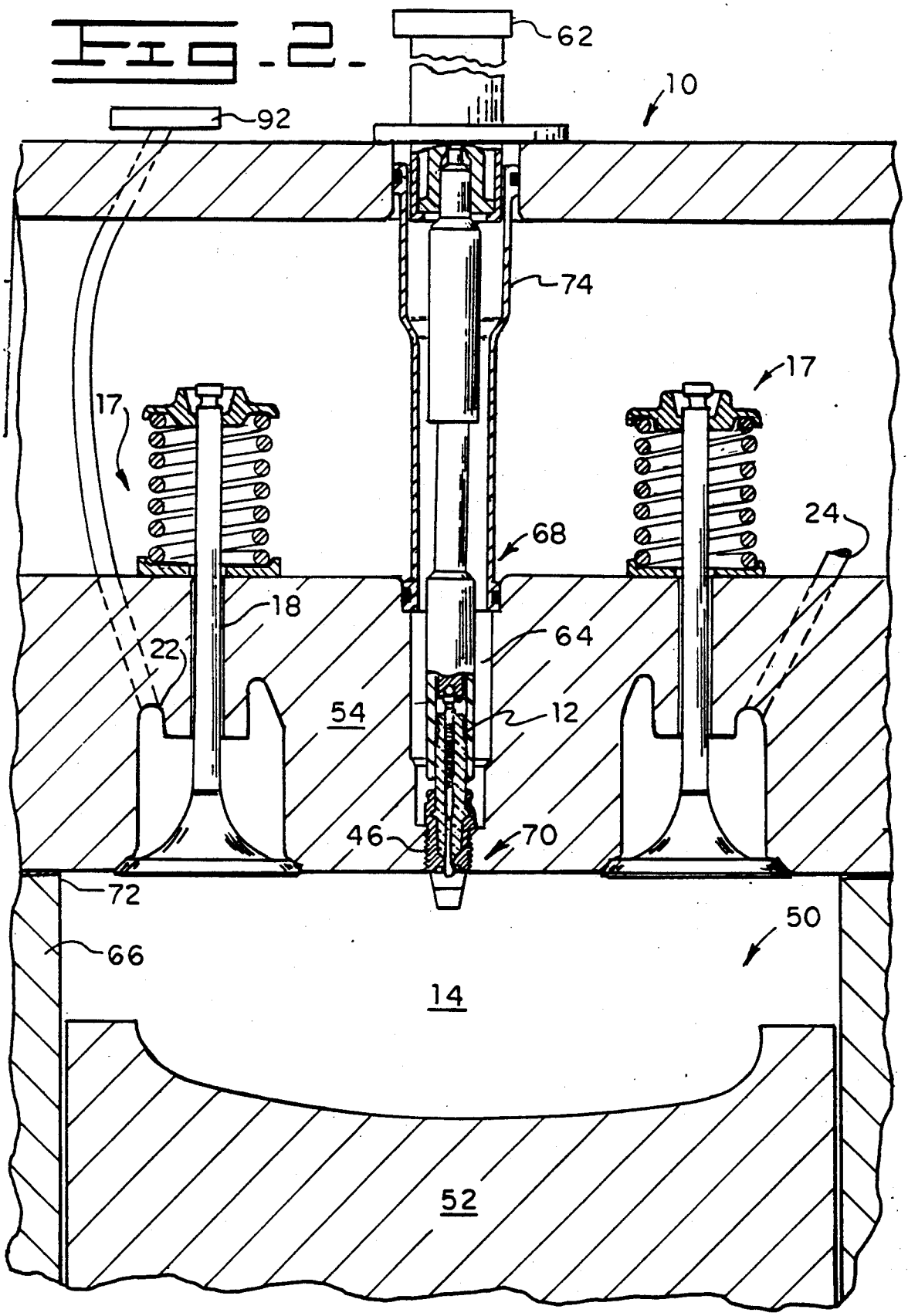
FIG. 2 is a diagrammatic sectional view of a portion of a preferred spark ignited engine.

Referring to FIG. 3, the orifices 30 are holes in the capsule 48 which control the exchange of fuel/air gases between the ignition chamber 16 and the combustion chamber 14 (FIG. 2). The orifices 30 are angularly, preferably tangentially, disposed to the vertical centerline of the ignition chamber 16. There are at least two orifices 30, preferably four. The orifices 30 are preferably spaced equidistant around the capsule 48. The center lines of the orifices 30 are on a plane in the range of about 0.9 to about 1.7 cm, preferably about 1.1 centimeters below the center electrode 34 as shown by the numeral 100 in FIG. 1, and about 2 millimeters above the inside bottom of 48. The orifices 30 preferably are inclined slightly upwardly from the bottom of the capsule as viewed in passing from outside the capsule 48 to inside. A preferred angle as shown by the numeral 110 in FIG. 1, is in the range of 14 to 18 degrees, most preferably about 16 degrees. In a preferred embodiment, in addition to the four orifices 30 is one bottom axial orifice 32. In a preferred embodiment, the orifices 30,32 have a diameter as shown by the numeral 120 in FIG. 1, of from about 0.9 to 1.7 millimeters most preferably about 1.5 millimeters. Such controlled sized orifices increase the velocity of gaseous fuel entering and exiting the ignition chamber 16 (FIG. 1).

Referring to FIG. 1, the center electrode 34 extends throughout the length of and beyond the ends of the insulator 26 and shell 28, as is conventional. Attached to or unitary with the capsule 48 is the ground electrode 36. The ground electrode 36 can be formed unitary with the capsule 48 or sealably attached thereto by other means such as welding. The center electrode 34 and the ground electrode 36 form between then an electrode gap 38, the electrode gap 38 being substantially centered in the ignition chamber 16. As used herein, the words "substantially centered" or "centered" refer to the positioning of the electrode gap 38 substantially equidistant from the inside walls of the capsule 48 and such words are not intended to refer to the vertical positioning of the electrode gap 38 with respect to the top and bottom of the capsule 48.

Figure 4:
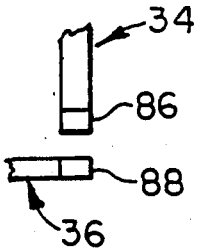
FIG. 4 is a diagrammatic partial view of the electrode tips.

Referring to FIG. 4, in a preferred embodiment, the center electrode 34 and the ground electrode 36 are substantially nickel. In order to extend the useful life of the electrodes 34,36 and thus the spark plug, precious metals are affixed to the tips 86,88 of the electrodes 34,36. As used herein, the word "tip" refers to the relatively small location on an electrode at which the spark makes contact. Welded to the tip 86 of the center electrode 34 is a piece of iridium and welded to the tip 88 of the ground electrode 36 is a piece of platinum. These pieces are 0.1 length by 0.03 width by 0.03 thickness inch (2.5 mm length, 0.8 mm width and thickness). The spark arcs between the iridium on the center electrode 34 and the platinum on the ground electrode 36.

Referring to FIG. 1, the insulator 26 of the spark plug 12 can be of conventional materials, a preferred material being ceramic. The insulator 26 should be long enough to prevent arc over between the system's energy source 62 (FIG. 2) and the shell 28 of the spark plug 12. In a spark ignited engine 10 having an energy source 62 producing at least 8000 volts to ignite the gaseous methane, the insulator 26 preferably extends a length of at least 5.2 centimeters above the shell 28 as shown by the numeral 130 in FIG. 1.

Referring to FIG. 2 engine 10 has an engine head 54 which covers an engine block 66. In the engine block 66 are piston cylinders 50. A spark plug well 64 extends between the electrical power source 78 and piston cylinder 50. The spark plug well 64 is a passage in the engine head 54. The spark plug well 64 has a first end 68 adjacent which is located the energy source 62 and a second end 70 at which is located the threaded hole 46 of the engine head 54 into which is screwed the spark plug 12. A first end 72 of the piston cylinder 50 is adjacent the second end 70 of the spark plug well 64. Each piston cylinder 50 houses a piston 52. Adjacent the first end 72 of the piston cylinder 50 are valve means 17. A preferred piston cylinder 50 has four valves, two intake valves 18 (one shown) which regulate fuel and air intake through intake ports 22 and two exhaust valves 20 (one shown) which regulate exhaust gas through exhaust ports 24, as is shown in the art.

The volume of the piston cylinder 50 above the piston 52 and below the valves is the combustion chamber 14. The threaded hole 46 in the engine head 54 is substantially centrally located over the piston cylinder 50 so that the capsule 48 of the spark plug 12, when screwed into the threaded hole 46, is substantially centrally located in the combustion chamber 14. When the spark plug 12 is seated in the threaded hole 46 of the engine head 54, at least that portion of the capsule 48 including the orifices 30,32 is located within the combustion chamber 14.

In a preferred embodiment of the present invention, an ignition extender 74 extends between the electrical energy source 62 and the spark plug 12. Such an extender 74 is especially valuable when the spark plug well 64 is relatively long and the energy source 62 cannot be attached directly to the spark plug 12. In a preferred embodiment of an engine 10 utilizing spark plugs 12 of the type described herein, the spark plug well 64 has a length of 25 centimeters. A preferred extender 74 has a tubular insulating member fixedly attached to and surrounding at least a portion of an electrically conductive core. The insulating member preferably is of polytetrafluoroethylene.

Industrial Applicability

Upon the down stroke of the piston 52 in the piston cylinder 50, the intake valves 18 are raised, in the usual well known manner, and a fresh charge of fuel gas and the air are drawn from the gaseous fuel system 92 and into the combustion chamber 14.

During the succeeding compression stroke of the piston 52 the gas fuel and air mixture in the combustion chamber 14 is compressed thus causing some of the fuel and air to pass through the orifices 30 of the capsule 48 into the ignition chamber 16 of the spark plug 12. As the gas fuel and air are forced through the orifices 30 its velocity is increased. Increasing the velocity of the gas fuel and air entering the ignition chamber 16 increases the pressure drop between the Combustion chamber 14 and the ignition chamber 16 which results in the electrode gap 38 seeing a lower pressure, which in turn results in a lower voltage requirement to produce a spark. The end result is that less voltage need be supplied to produce a spark, thus allowing the insulator 26 length to be kept within tolerable limits while still protecting against arc over. Also, by reducing the voltage, the electrodes 34,36 are subjected to less electrical erosion thus prolonging their life.

The tangential and slightly upward directioning of the orifices 30 sets the gas fuel entering the ignition chamber 16 into a swirling or tornado-like motion upwards towards and around the electrode gap 38. The swirling motion creates a centrifuge that throws the heavier molecules of the gas fuel to the outside of the swirl. Because the gas fuel is lighter-than-air, it is the air molecules in the gas and air mixture that are thrown to the outside of the swirl creating a gas poor region along the inside wall of the capsule 48 while the fuel molecules are left in the center of the swirl creating a gaseous fuel rich region in the center of the ignition chamber 16. Another advantage of having the gas fuel and air mix enter the ignition chamber 16 at a higher velocity is seen in that the centrifugal effect in the capsule 48 is increased thus resulting in more air molecules being thrown to the inside wall of the capsule 48 leaving an even richer region of gas molecules in the center of the capsule 48 at the electrode gap 38.

After initial ignition in the ignition chamber 16, the flame front leaves the capsule 48 and is directed slightly downward into the combustion chamber 14 thereby creating greater turbulence and increasing the availability of gas fuel to the flame than if the flame front exited horizontally or even worse, upwards. Also, increasing the velocity of the exiting flame front creates a quicker and more complete combustion because the flaming jets are able to penetrate further into the combustion chamber 14 before dissipation.

As stated before, the electrode gap 38 is substantially at the center of the ignition chamber 16 about which and through the rich gas and air mix is swirling. When a spark is created at the electrode gap 38, the rich mixture is ignited. As the gas burns, the swirl quickly propagates the combustion in the ignition chamber and tremendous heat and energy is created causing the gas to expand and the flame front to propagate. The flame bursts back through the orifices 30,32 at a great velocity into the combustion chamber 14 causing extreme turbulence and deep penetration. The turbulent burning gas ignites, expands, and forces the piston 52 down.

I claim:

1. A spark plug specially adapted for use in a lighter-than-air gaseous fuel burning engine having a shell, a center electrode, and a ground electrode, said electrodes spaced one from the other and forming an electrode gap, comprising:

an insulator fixedly held in said shell and extending at least 5.2 centimeters beyond said shell, and a capsule having an ignition chamber and an orifice system for the controlled exchange of gases into and from said ignition chamber, said capsule being connected to said spark plug shell and surrounding said electrode gap, said electrode gap being substantially centered within said ignition chamber, said orifice system having a plurality of orifices of a size, orientation and position adapted for the entry of fuel gas and air through said orifices, into said ignition chamber, and along a swirling pathway around said electrode gap.

2. A spark plug, as set forth in claim 1, wherein said capsule has tangential orifices each of a diameter in the range of about 1 millimeter to about 1.7 millimeters.

3. A spark plug, as set forth in claim 1, wherein the orifices of the orifice system are substantially equally spaced one from the other on a plane in the range of about 0.9 cm to about 1.7 cm from the center electrode in a direction away from the spark plug shell, said orifices are tangentially directed relative to the longitudinal centerline of the ignition chamber, inclined in a vertical direction toward the electrodes and are of a diameter of about 1.5 millimeters.

4. A spark plug as set forth in claim 3, wherein the orifices are positioned on a plane about 1.1 cm from the center electrode.

5. A spark plug as set forth in claim 3, wherein each orifice angle of inclination is in the range of about 14 degrees to about 18 degrees.

6. A spark plug, as set forth in claim 3, wherein each orifice angle of inclination is about 16 degrees.

7. A spark ignited gaseous fueled power system, comprising:

an engine head having a spark plug well having first and second ends and a length of at least 25 centimeters;

an engine block having a piston, a piston cylinder, and a combustion chamber defined by said piston, piston cylinder, and said second end of said spark plug well;

a plurality of valves means for the intake and exhaust of gases from the combustion chamber;

a spark plug having a shell, an insulator, a center electrode, a ground electrode, and a capsule, said insulator being fixedly held in the shell, extending about and through said shell and at least 5.2 centimeters beyond said shell, said electrodes being spaced one from the other and defining an electrode gap therebetween, said capsule having an ignition chamber and an orifice system for the controlled exchange of gases into and from the ignition chamber, said capsule being connected to the spark plug shell, surrounding said electrode gap, and being substantially centered within said combustion chamber, said orifice system having a plurality of orifices of a size, orientation and position adapted for the entry of gases through the orifices, into the ignition chamber, and along a swirling pathway around the electrode gap, said orifices being positioned within said engine block combustion chamber;

an insulated spark plug extender connected to said spark plug and extending toward the first end of said spark plug well;

a power source adapted to deliver at least 8000 volts and being connected to the spark plug extender; and means for controllably delivering fuel gas into the combustion chamber.

8. The power system, as set forth in claim 7, wherein said capsule has a plurality of tangential orifices, said orifices each having a diameter in the range of about 0.9 millimeter to about 1.7 millimeters.

9. The power system, as set forth in claim 8, wherein said ground electrode has a tip formed of platinum.

10. The power system as set forth in claim 9, wherein said center electrode has a tip formed of iridium.

11. A spark plug having a shell, a center electrode, and a ground electrode, said electrodes spaced one from the other and forming an electrode gap, comprising:

an insulator fixedly held in said shell and extending at least 5.2 centimeters beyond said shell, and a capsule having an ignition chamber and an orifice system for the controlled exchange of gases into and from said ignition chamber, said capsule being connected to said spark plug shell and surrounding said electrode gap, said electrode gap being substantially centered within said ignition chamber, said orifice system having a plurality of orifices of a size, orientation and position adapted for the entry of fuel gas and air through said orifices, into said ignition chamber, and along a swirling pathway around said electrode gap, said orifices being substantially equally spaced one from the other on a plane in the range of about 0.9 cm to about 1.7 cm from said center electrode in a direction away from said spark plug shell, said orifices being tangentially directed relative to the longitudinal centerline of said ignition chamber, inclined in a vertical direction toward said electrodes and of a diameter of about 1.5 millimeters.

* * * * *